United States Patent [19]

Fischer

[11] Patent Number: 4,690,059

[45] Date of Patent: Sep. 1, 1987

[54] METHOD OF MAINTAINING AN UNINTERRUPTED WARNING SIGNAL

[76] Inventor: Edgar E. Fischer, 936 Johnston Dr., Watchung, N.J. 07060

[21] Appl. No.: 832,318

[22] Filed: Feb. 24, 1986

[51] Int. Cl.[4] ..... F42B 4/24; F42B 4/20

[52] U.S. Cl. ..... 102/336; 102/343; 102/360

[58] Field of Search ..... 102/336, 343, 360, 344, 102/345; 431/126

[56] References Cited

U.S. PATENT DOCUMENTS

| | | | |
|---|---|---|---|
| 356,135 | 1/1887 | Jordan | 102/343 |
| 362,905 | 5/1887 | Sibley | 102/343 |
| 617,376 | 1/1899 | Warner | 102/344 |
| 794,371 | 7/1905 | Matthew | 102/343 |
| 1,154,165 | 9/1915 | Beckwith | 102/344 |
| 2,120,580 | 6/1938 | Sherman | 102/344 |
| 3,149,566 | 9/1964 | Klinger | 102/501 |
| 3,283,717 | 11/1966 | Balch | 102/344 |
| 4,148,258 | 4/1979 | Powers | 102/343 |

*Primary Examiner*—Deborah L. Kyle
*Assistant Examiner*—Ted L. Parr

[57] ABSTRACT

An emergency flare for road and railway use which changes so a different color during the final stage of illumination, thus warning that burnout is approaching, and thereby allowing time for replacement or other means to warn oncoming traffic.

2 Claims, 2 Drawing Figures

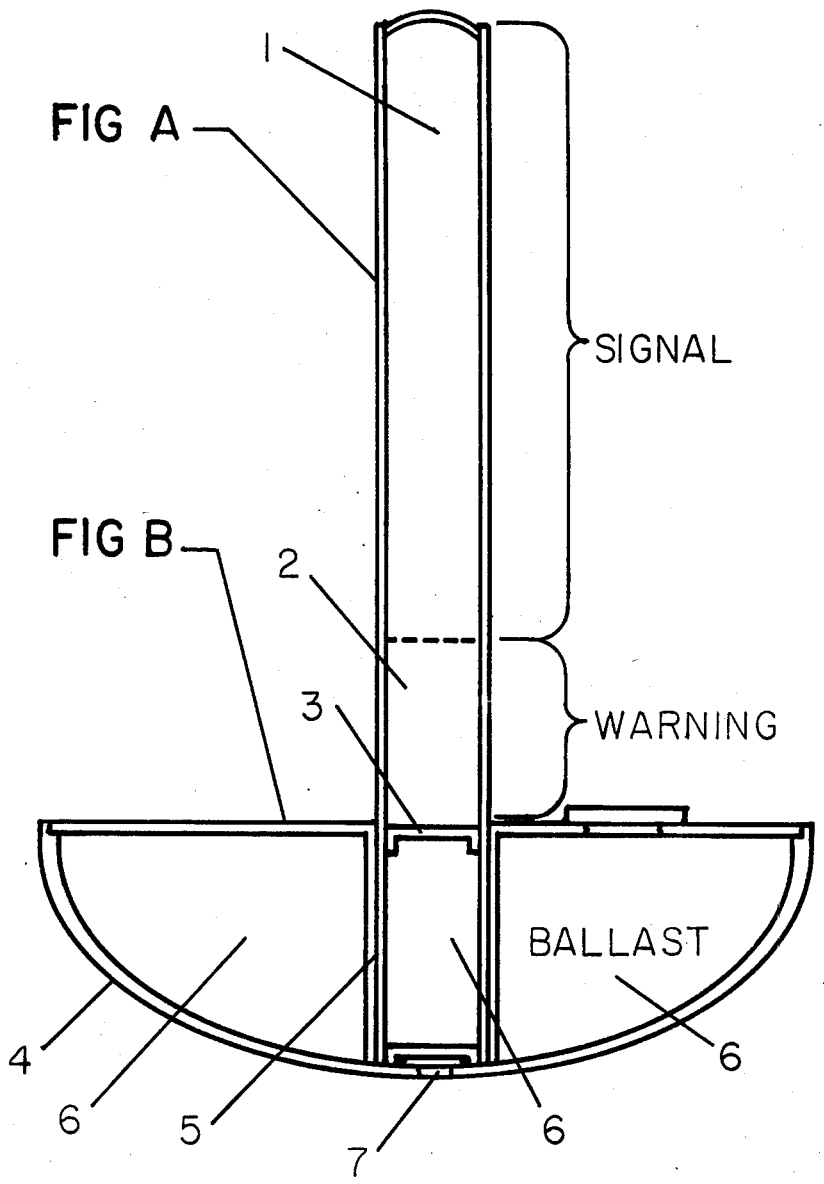
1
FIG A
SIGNAL
FIG B
2
3
WARNING
BALLAST
4
6
5
7
6
6

METHOD OF MAINTAINING AN UNINTERRUPTED WARNING SIGNAL

BACKGROUND OF THE INVENTION

The present invention pertains to road and railway emergency flares. Ordinary flares burnout without warning, leaving on-coming traffic ignorant of the emergency ahead.

SUMMARY OF THE INVENTION

The purpose of this invention is to reduce the possibility of accidents caused by disabled road or railway traffic. The invention is a method of using an improved version of the ordinary type of the emergency road and railway flare, in that it will automatically change color or colors, without interruption to warn that burnout is approaching. This is accomplished by utilizing different chemicals or substances in the final stage of the flare. This will allow time for replacement or other means to warn oncoming traffic.

A separate reusable base of the flare is rounded to prevent tip over due to excessive wind or turbulence because of the passing traffic. The base is constructed by utilizing a thin, brittle type of nonflammable material filled with a suitable ballast. Thus, by avoiding the use of metal for support, the base, if abandoned, will be safely distintegrated by later traffic and diffused by wind and rainfall. A means to attach flare to base, utilizes a socket installed in the exact center of the base.

BRIEF DESCRIPTION OF THE DRAWING

FIG. A shows a cross-sectional view of the flare.
FIG. B shows a cross-sectional view of the base.

DESCRIPTION OF THE PREFERRED EMBODIMENT

As shown in FIG. A the flare is comprised of a main or signal stage 1, a final or warning stage 2 and a plug-in section 3 which plugs into a socket 5 in the exact center of a reusable dish type base 4. The plug-in section 3 of the flare contains a ballast 6 to counter-balance the flare. The base has a rounded bottom and contains ballast 6 so that it maintains the flare in an upright vertical position despite excessive wind or turbulence. The ballast is held in the base by a sealed cover. The base has an opening 7 in its bottom aligned with the bottom of the flare to permit ejection of the remains of a burned out flare with a pencil or other suitable tool. All materials of the base are nonflammable and nonmetallic.

What is claimed is:

1. A method of maintaining an uninterrupted warning signal comprising:

(a) lighting a warning flare which changes color a predetermined time before burnout to alert a user that burnout is approaching; and (b) providing another warning means when the flare changes color.

2. A method according to claim 1 wherein the step of providing another warning means involves lighting another flare.

* * * * *